United States Patent [19]

McGarry et al.

[11] Patent Number: 4,514,291

[45] Date of Patent: Apr. 30, 1985

[54] APPARATUS AND METHOD FOR FLOTATION SEPARATION UTILIZING AN IMPROVED SPIRAL SPRAY NOZZLE

[75] Inventors: Phillip E. McGarry, Palmerton; David E. Herman, Jim Thorpe; Robert A. Treskot, Walnutport; David C. Fistner, Sr., Bethlehem, all of Pa.

[73] Assignee: The Standard Oil Company, Cleveland, Ohio

[21] Appl. No.: 495,626

[22] Filed: May 18, 1983

[51] Int. Cl.[3] ..... B03D 1/14

[52] U.S. Cl. ..... 209/166; 209/170

[58] Field of Search ..... 209/500, 502, 166, 167, 209/169, 170, 171, 488, 489, 498, 499; 210/704, 705, 519; 239/501

[56] References Cited

U.S. PATENT DOCUMENTS 2,804,341 8/1957 Bete ..... 239/601

4,304,573 12/1981 Burgess et al. .

4,347,126 8/1982 McGarry et al. .

4,347,127 8/1982 Duttera et al. .

*Primary Examiner*—Bernard Nozick

*Attorney, Agent, or Firm*—Bruce E. Harang; David J. Untener; Larry W. Evans

[57] ABSTRACT

An improved method and apparatus for froth flotation separation of the components of a slurry, having particular utility for the beneficiation of coal by the flotation separation of coal particles from impurities associated therewith, such as ash and sulfur. In this arrangement, an improved open flow, spiral nozzle is positioned above a flotation tank having a bath therein, and sprays an input slurry through an aeration zone into the surface of the water. The spraying operation creates a froth on the water surface in which a substantial quantity of particulate matter floats, while other components of the slurry sink into the water bath. A skimming arrangement skims the froth from the water surface as a cleaned or beneficiated product.

7 Claims, 7 Drawing Figures

NOZZLE PRESSURE RECOVERY CURVES ON ILLINOIS ROM (S-4200)

APPARATUS AND METHOD FOR FLOTATION SEPARATION UTILIZING AN IMPROVED SPIRAL SPRAY NOZZLE

BACKGROUND OF THE INVENTION

1. Field of the Invention

The present invention relates generally to a method and apparatus for flotation separation of coal particles and similar materials, and more particularly pertains to an improved method and apparatus for beneficiating coal by flotation separation of a froth generated by a spiral, open flow spray nozzle such that ground coal particles may be separated from impurities associated therewith such as ash and sulfur.

Coal is an extremely valuable natural resource in the United States because of its relatively abundant supplies. It has been estimated that the United States has more energy available in the form of coal than in the combined natural resources of petroleum, natural gas, oil shale, and tar sands. Recent energy shortages, together with the availability of abundant coal reserves and the continuing uncertainties regarding the availability of crude oil, have made it imperative that improved methods be developed for converting coal into a more useful energy source.

2. Discussion of the Prior Art

Many known prior art processes for froth flotation separation of a slurry of particulate matter are based on constructions wherein air is introduced into the liquid slurry of particulate matter, as through a porous cell bottom or a hollow impeller shaft, thereby producing a surface froth. These prior art methods are relatively inefficient approaches, especially when large amounts of particulate matter are being processed. Generally, these techniques are inefficient in providing sufficient contact area between the particulate matter and the frothing air. As a result, large amounts of energy were required to be expended to generate the froth. In addition, froth flotation techniques which permit bubbles to rise in the slurry can tend to trap and carry impurities such as ash in the froth slurry, and accordingly the resultant beneficiated particulate product frequently has more impurities therein than necessary.

Methods have been suggested and are being explored in the beneficiation of coal, i.e., the cleaning of coal of impurities such as ash and sulfur, either prior to burning the coal or after its combustion. In one recently developed technique for beneficiation, termed herein chemical surface treating, raw coal is pulverized to a fine mesh size and is then chemically treated. According to this technique, the treated coal is then separated from ash and sulfur, and a beneficiated or cleaned coal product is recovered therefrom. In further detail, in the heretofore mentioned chemical surface treating process, coal is first cleaned of rock and the like, and is then pulverized to a fine size of about 48 to 300 mesh. The extended surfaces of the ground coal particles are then rendered hydrophobic and oleophilic by a polymerization reaction. The sulfur and mineral ash impurities present in the coal remain hydrophilic and are separated from the treated coal product in a water washing step. This step utilizes oil and water separation techniques, and the coal particles made hydrophobic can float in recovery on a water phase which contains hydrophilic impurities.

In greater detail, McGarry et al. U.S. Pat. No. 4,347,126 and Duttera et al. U.S. Pat. No. 4,347,121, both of which are commonly assigned herewith, disclose similar arrangements for the beneficiation of coal by the flotation separation of coal particles from impurities associated therewith such as ash and sulfur. In these arrangements, a primary spray hollow jet nozzle is positioned above a flotation tank having a water bath therein, and sprays an input slurry through an aeration zone into the surface of the water. The spraying operation creates a froth on the water surface in which a substantial quantity of particulate matter floats, while other components of the slurry sink into the water bath. A skimming arrangement skims the froth from the water surface as a cleaned or beneficiated product. A recycling operation is also provided wherein particulate materials which do not float after being sprayed through the primary spray nozzle are recycled to a further recycle, hollow jet spray nozzle to provide a second opportunity for recovery of the recycled particles.

One type of spray nozzle currently being used in a coal beneficiation process of the type described in these patents is a full jet nozzle, as is available commercially from Spraying Systems, Co., Wheaton, Ill. Several problems have arisen with this particular nozzle design, including a recurring problem with clogging thereof. Tank covers, filter systems, larger nozzles and extreme care and frequent cleaning were necessary to alleviate this problem.

The full jet nozzle is characterized by a multiplicity of small apertures therein which results in the development of a substantial back pressure across each nozzle during its operation. Laboratory studies have demonstrated that this type of nozzle design creates too high of a back pressure in the system which resulted in wide discrepencies in test results thereof and reduced capacity. This type of hollow cone nozzle, with its high back pressure thereacross, is also subject to high wear because of its structural design.

The spiral, open flow type of nozzle contemplated for use in association with the present invention is available commercially from several different manufacturers in many different types of materials including polypropylene and tungsten carbides. The test results disclosed herein were run on a spiral nozzle from Bete Fog Nozzle, Inc., Greenfield, Mass. 01301. Although nozzles of this type have been used commercially in various commercial enterprises, they have not been utilized in froth flotation separation or in a manner similar to that taught by the present invention.

SUMMARY OF THE INVENTION

Accordingly, it is a primary object of the present invention to provide an improved method and apparatus for froth flotation of a slurry of particulate matter by the use of an improved type of spray nozzle. In greater particularity, it is a more detailed object of the present invention to provide an improved method and apparatus for beneficiating coal by a froth flotation separation of ground coal particles from impurities associated therewith through the use of an improved spiral or helix, open flow type of nozzle.

A further object of the subject invention is the provision of an improved method and apparatus for producing improved aeration in a flotation tank to generate froth of particulate material such as carbonaceous particles, noncarbonaceous particles, or mixtures of both, coal particles, mine tailings, oil shale, residuals, waste particulates, mineral dressings, graphite, mineral ores, fines, etc.

Another object of the present invention is to provide a method and apparatus for froth flotation separation which is more efficient and results in a cleaner product and in more efficient production than prior art operations.

The foregoing objects are accomplished herein by a process which sprays the slurry through an aeration zone in which substantially greater quantities of air are sorbed by the sprayed droplets of the slurry, which are finer droplets than those produced by prior art nozzles. Accordingly, greater quantities of air are introduced into the froth in a manner which is quite different and advantageous relative to prior art approaches. The advantages of this manner of froth generation make the teachings herein particularly applicable to froth flotation separation of slurries which have a substantial proportion of particulate matter. In fact, the larger free passage area of a spiral, open flow spray nozzle allows slurries with larger size particles therein to be sprayed through the nozzle without problems with blockage thereof. The added quantities of air result in a more buoyant slurry of particulate matter being sprayed into the water surface to a lesser depth in a more shallow turbulence zone, which resulted in greater turbulence therein.

In accordance with the teachings herein, the present invention provides an improved method and apparatus for froth flotation separation of the components of a slurry having particulate matter therein. In this arrangement, at least one spiral, open flow spray nozzle is positioned above a flotation tank having a liquid bath therein, and sprays, as a diverging spray pattern of fine droplets, an input slurry containing particulate matter through an aeration zone into the surface of the liquid. The spraying operation creates a froth on the surface of the liquid in which a quantity of the particulate matter floats, such that the froth containing the particulate matter can be removed from the water surface as a separated product.

The spiral, open flow type of nozzle taught by the present invention has a number of distinct advantages relative to a prior art standard hollow jet type of nozzle. The spiral nozzle is not characterized by a multiplicity of small apertures therein, and rather has an open flow type of design which results in a greater throughput of sprayed slurry in a hollow cone spray pattern without a substantial pressure drop across the nozzle. The lower operational pressure and the elimination of a multiplicity of small apertures results in a substantially lesser wear rate than prior art types of nozzles. This advantage is significant when considering the nature of the sprayed materials, i.e., a slurry of particulate matter. Moreover, the open flow design of the spiral nozzle eliminates the possibility of blockage thereof to a much greater degree than prior art types of nozzles, and also allows larger particle sizes to be sprayed through the nozzle without problems with blockage thereof.

In accordance with further details of the present invention, the spray nozzle is preferably a hollow cone type of nozzle defining an approximately 50° spray pattern. Further, the slurry is preferably supplied to the nozzle in a pressure range of from 2 to 25 psi, and more preferably in the range of from 10 to 20 psi. Also, the present invention has particular utility to a coal beneficiation operation for froth flotation separation of a slurry of coal particles and associated impurities. The present invention operates in a manner which is more efficient than prior art arrangements because of the unique manner of froth generation in which the slurry is sprayed through an aeration zone.

BRIEF DESCRIPTION OF THE DRAWINGS AND TABLES

The foregoing objects and advantages of the present invention for an arrangement for froth flotation separation utilizing an improved spiral nozzle may be more readily understood by one skilled in the art, with reference being had to the following detailed description of a preferred embodiment there, taken in conjunction with the accompanying drawings wherein like elements are designated by identical reference numerals through the several drawings, and in which.

Figure 3:
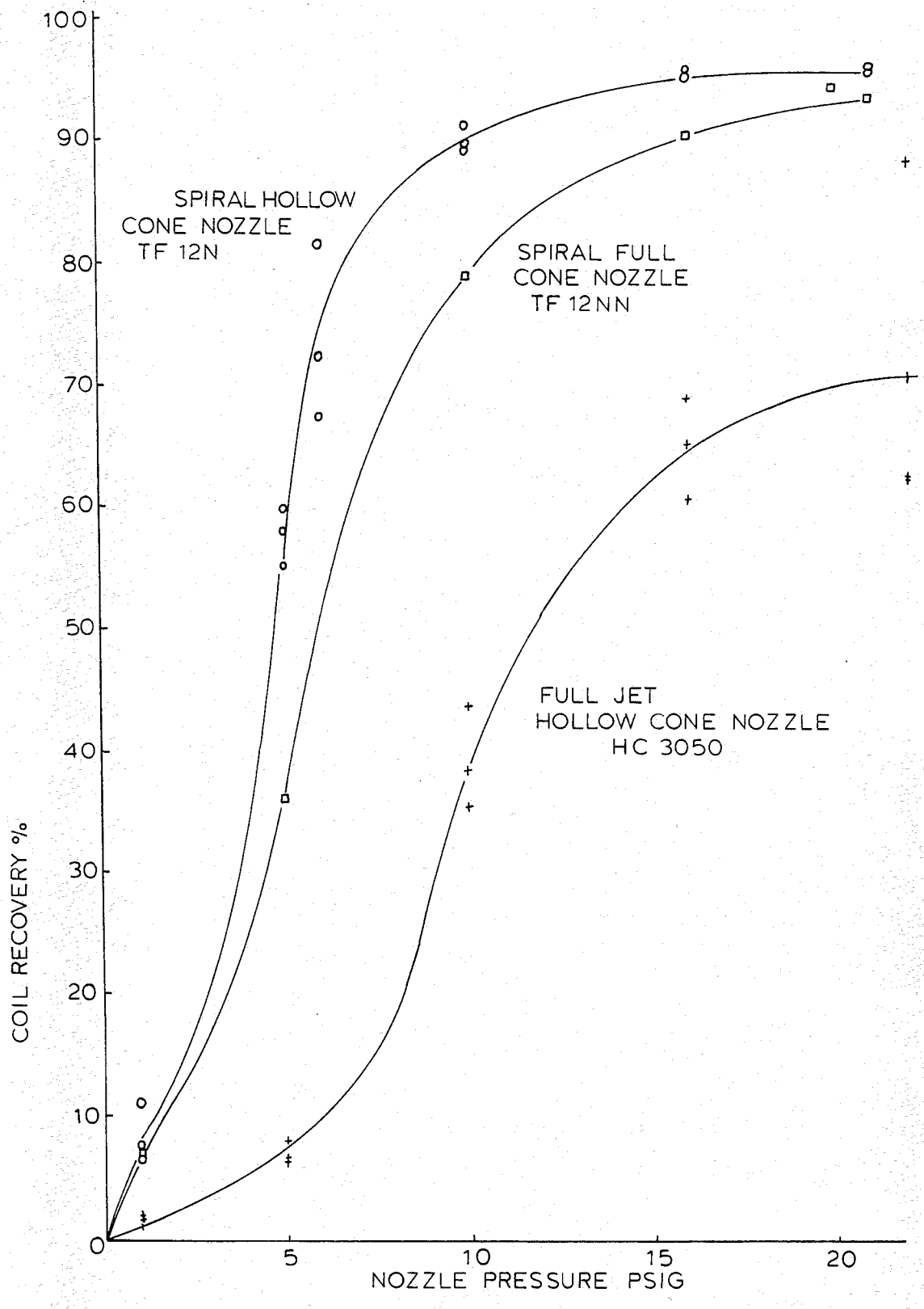
FIG. 3 illustrates several graphs of coal recovery of Illinois ROM coal, plotted as a function of nozzle pressure, and demonstrates the significantly improved results obtained pursuant to present invention.
Figure 4:
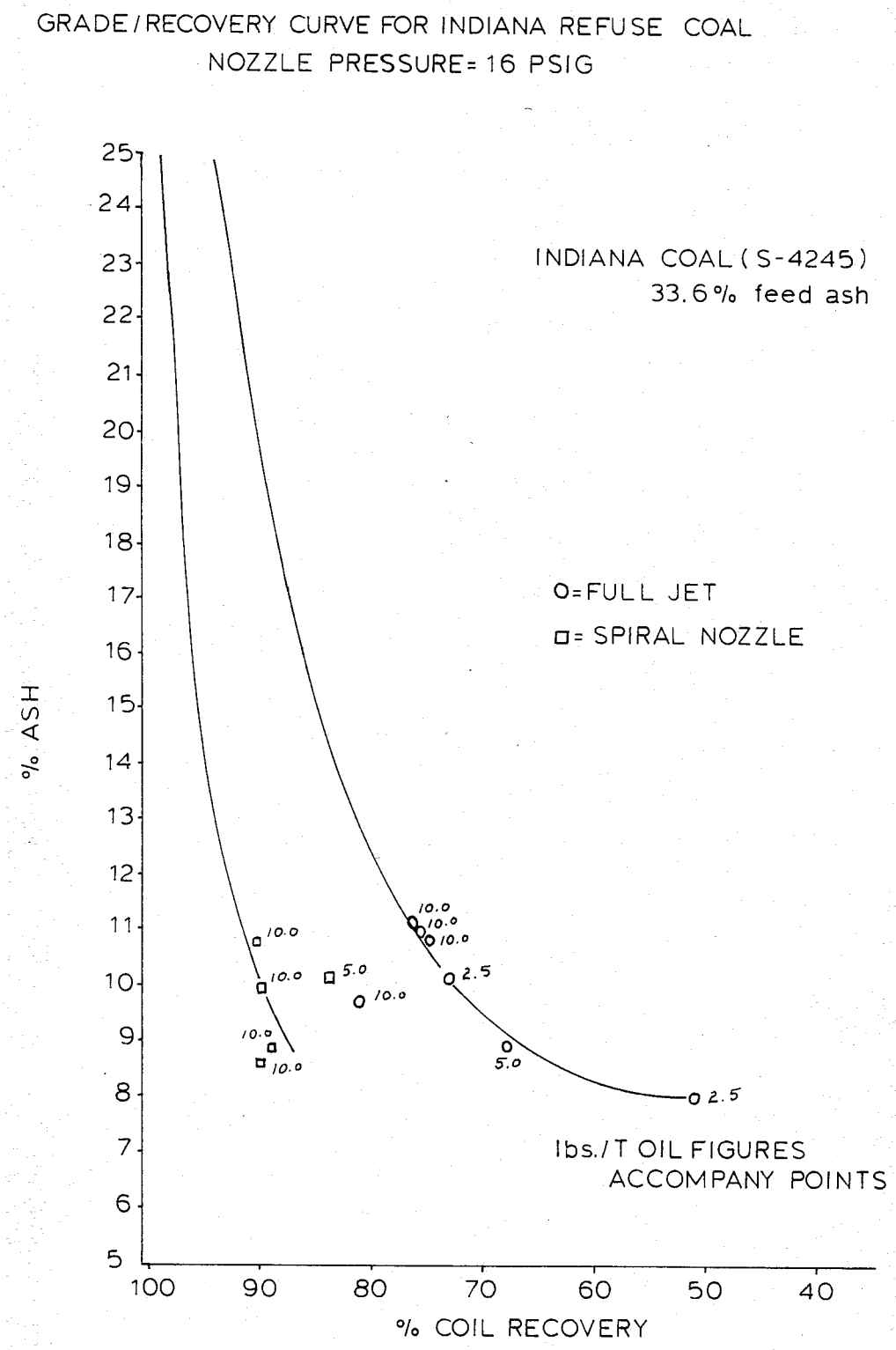
FIGS. 4 through 7 are respectively graphs of percent ash versus percent coal recovery for Indiana Refuse, Wyoming ROM, Alabama. flotation feed, and West Virginia flotation feed types of coal, all of which were conducted at a nozzle pressure of 16 psig.
Figure 5:
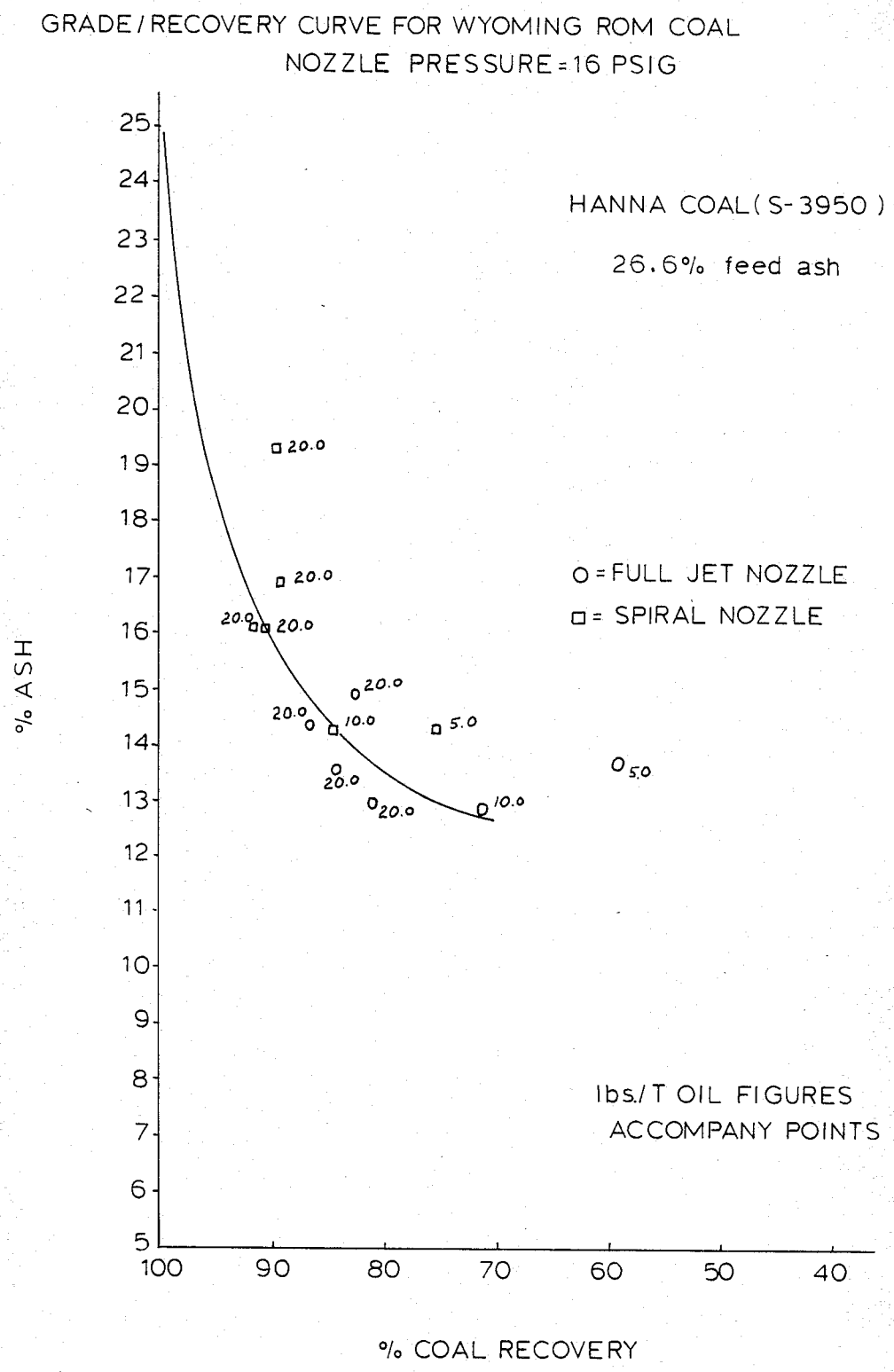
Figure 6:
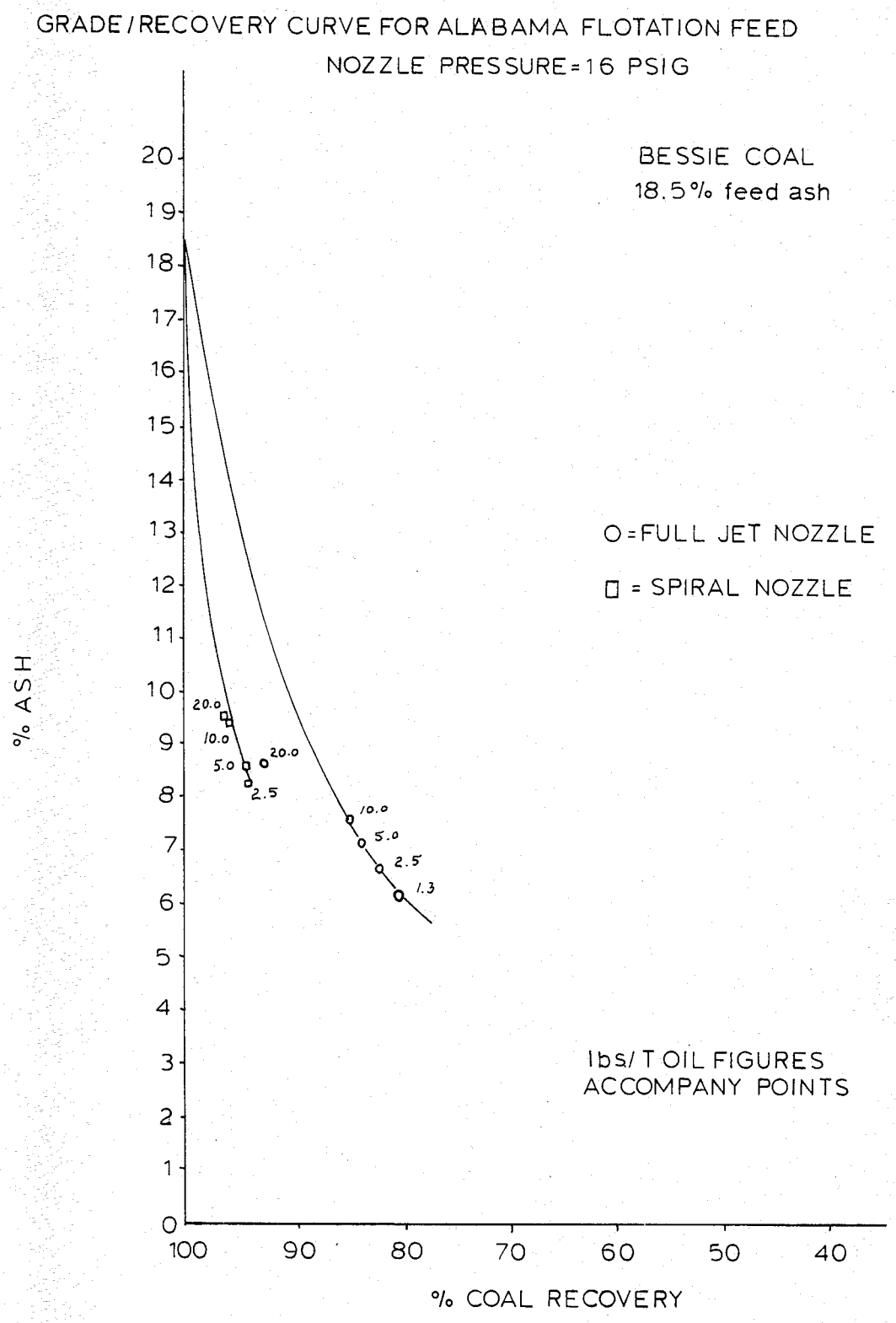
Figure 7:
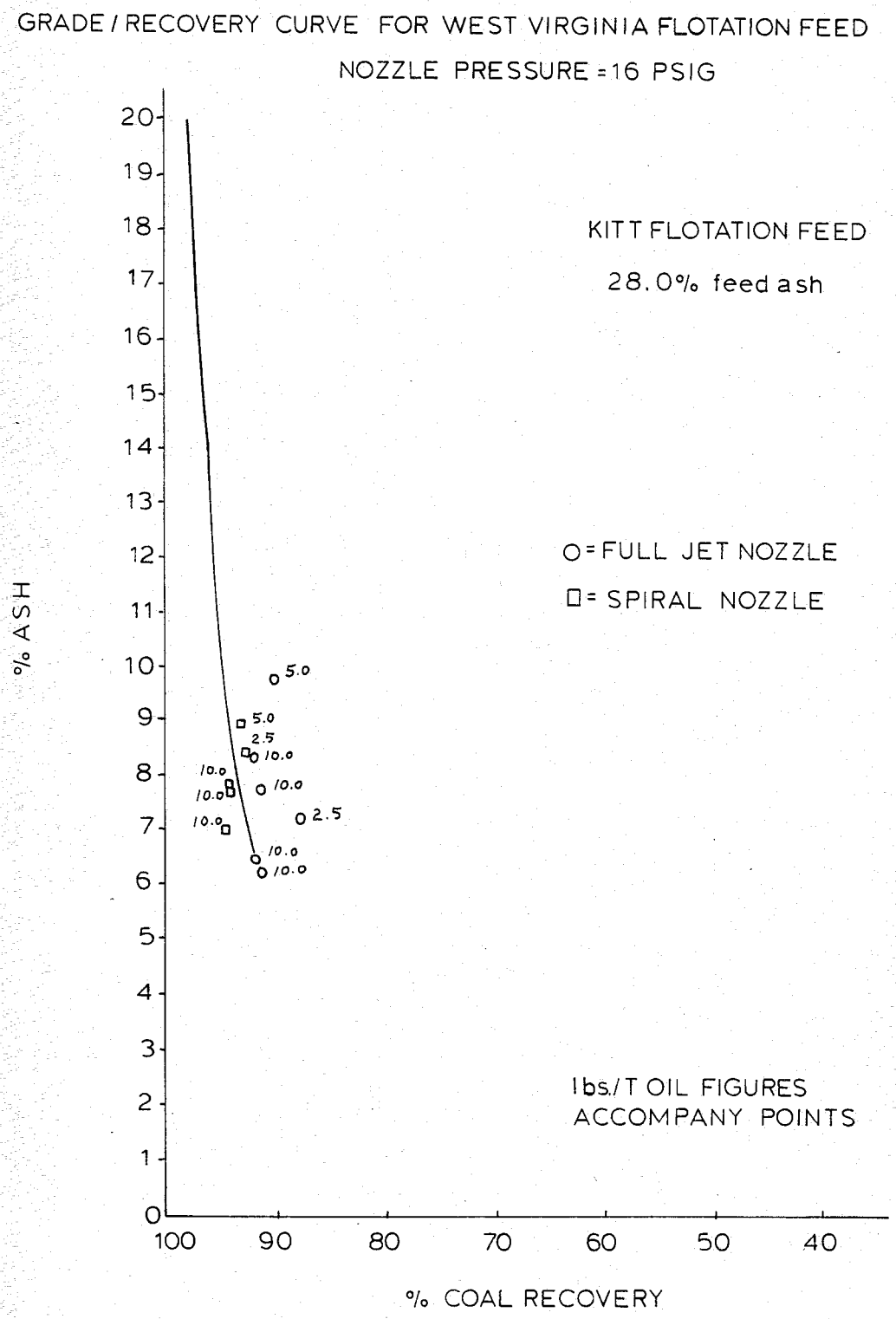

Tables 1 through 4 are data tables, including screen analysis and different nozzle tests, supporting the graph of FIG. 3 on Illinois ROM coal;

Tables 5 and 6 are screen analysis and nozzle comparison data tables, plotted in the graph of FIG. 4, on Indiana Refuse coal;

Tables 7 and 8 are screen analysis and nozzle comparison data tables, plotted in the graph of FIG. 5, on Wyoming ROM coal;

Tables 9 and 10 are screen analysis and nozzle comparison data tables, plotted in the graph of FIG. 6, on Alabama flotation feed coal;

Tables 11 and 12 are screen analysis and nozzle comparison data tables, plotted in the graph of FIG. 7, on West Virginia flotation feed coal; and Table 13 is a nozzle comparison data table of tests run on West Virginia flotation feed coal and Illinois run-of-mine coal.

DETAILED DESCRIPTION OF THE PRESENT INVENTION

Figure 1:
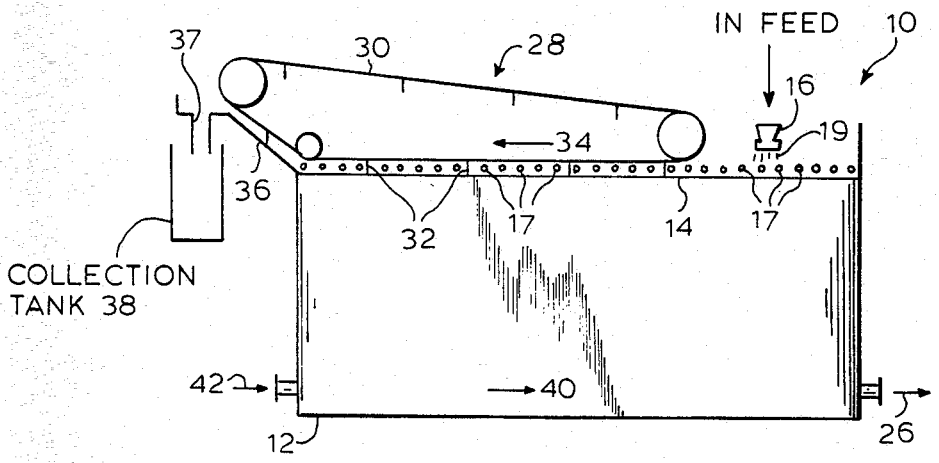
FIG. 1 is an elevational view of a schematic exemplary embodiment of a flotation arrangement constructed pursuant to the teachings of the present invention.

The apparatus and method of the present invention are adapted to the separation of a wide variety of solid-fluid streams by the creation of a solids containing froth phase, and are suitable for the separation of many types of particulate matter. However, the present invention is described herein in the context of a coal beneficiating operation. Thus, referring to the drawings in greater detail, FIG. 1 illustrates a first embodiment 10 of the present invention having a flotation tank 12 filled with water to level 14. In operation a slurry of finely ground coal particles, associated impurities, and if desired additional additives such as monomeric chemical initiators, chemical catalysts and fluid hydrocarbons is sprayed through at least one spiral. open flow nozzle 16 positioned at a spaced distance above the water level in tank 12. In alternative embodiments, two or more nozzles can be used to spray slurry and/or any other desired ingredients into the tank.

The stream of treated coal is pumped under pressure through a manifold to the spray nozzle 16 wherein the resultant shearing forces spray the coal flocculent slurry as fine droplets such that they are forcefully jetted into the mass of a continuous water bath in tank 12 to form a froth 17. High shearing forces are created in nozzle 16, and the dispersed particles forcefully enter the surface of the water and break up the coal-oil-water flocs, thereby water-wetting and releasing ash from the interstices between the coal flocs and breaking up the coal flocs so that exposed ash surfaces introduced into the water are separated from the floating coal particles and sink into the water bath. The surfaces of the finely divided coal particles now contain air sorbed to the atomized particles, much of which is entrapped by spraying the slurry through an aeration zone 19 such that air is sorbed in the sprayed slurry. The combined effects on the treated coal cause the flocculated coal to decrease in apparent density and to float as a froth 17 on the surface of the water bath. The hydrophilic ash remains in the bulk water phase, and tends to settle downwardly in tank 12 under the influence of gravity. Tank 12 in FIG. 1 may be a conventional froth flotation tank commercially available from KOM-LINE-Sanderson Engineering Co., Peapack, N.Y., modified as set forth below. The flotation tank can also include somewhat standard equipment which is not illustrated in the drawings, such as a liquid level sensor and control system, and a temperature sensing and control system.

The present invention operates on a froth generation principle in which the slurry is sprayed through an aeration zone such that substantially greater quantities of air are sorbed by the sprayed finer droplets of the slurry. Accordingly, air is introduced into the slurry in a unique manner to generate the resultant froth. The advantages of this manner of froth generation make the teachings herein particularly applicable to froth flotation separation of slurries which have a substantial proportion of particulate matter therein.

The particles in the floating froth created by nozzle 16 can be removed from the water surface by, e.g., a skimming arrangement 20 in which an endless conveyor belt 30 carries a plurality of spaced skimmer plates 32 depending therefrom. The skimmer plates are pivotally attached to the conveyor belt to pivot in two directions relative to the belt, and the bottom run of the belt is positioned above and parallel to the water surface in the tank. The plates 32 skim the resultant froth on the water surface in a first direction 34 toward a surface 36, preferably upwardly inclined, extending from the water surface to a collection tank 38 arranged at one side of the flotation tank, such that the skimmer plates 32 skim the froth from the water surface up the surface 36 and into the collection tank 38.

In the arrangement of the disclosed embodiment, the waste disposal at the bottom of the tank operates in a direction 40 flowing from an influent stream 42 to the effluent stream 26, while the skimmer arrangement at the top of the tank operates in direction 34 counter to that of the waste disposal arrangement. Although the illustrated embodiment shows a counterflow arrangement, alternative embodiments are contemplated within the scope of the present invention having, e.g., cross and concurrent flows therein.

Although not described in detail herein, a recycling arrangement similar to those described in U.S. Pat. Nos. 4,347,126 and 4,347,217 could also be utilized in association with the present invention, wherein a recycling technique is employed to further improve the efficiency relative to prior art arrangements. In the recycling technique, coal particles which do not float after being sprayed through the spray nozzle 16, designated a primary spray nozzle in context with this embodiment, are recycled to a further recycle spray nozzle to provide the coal particles a second cycle for recovery.

Figure 2:
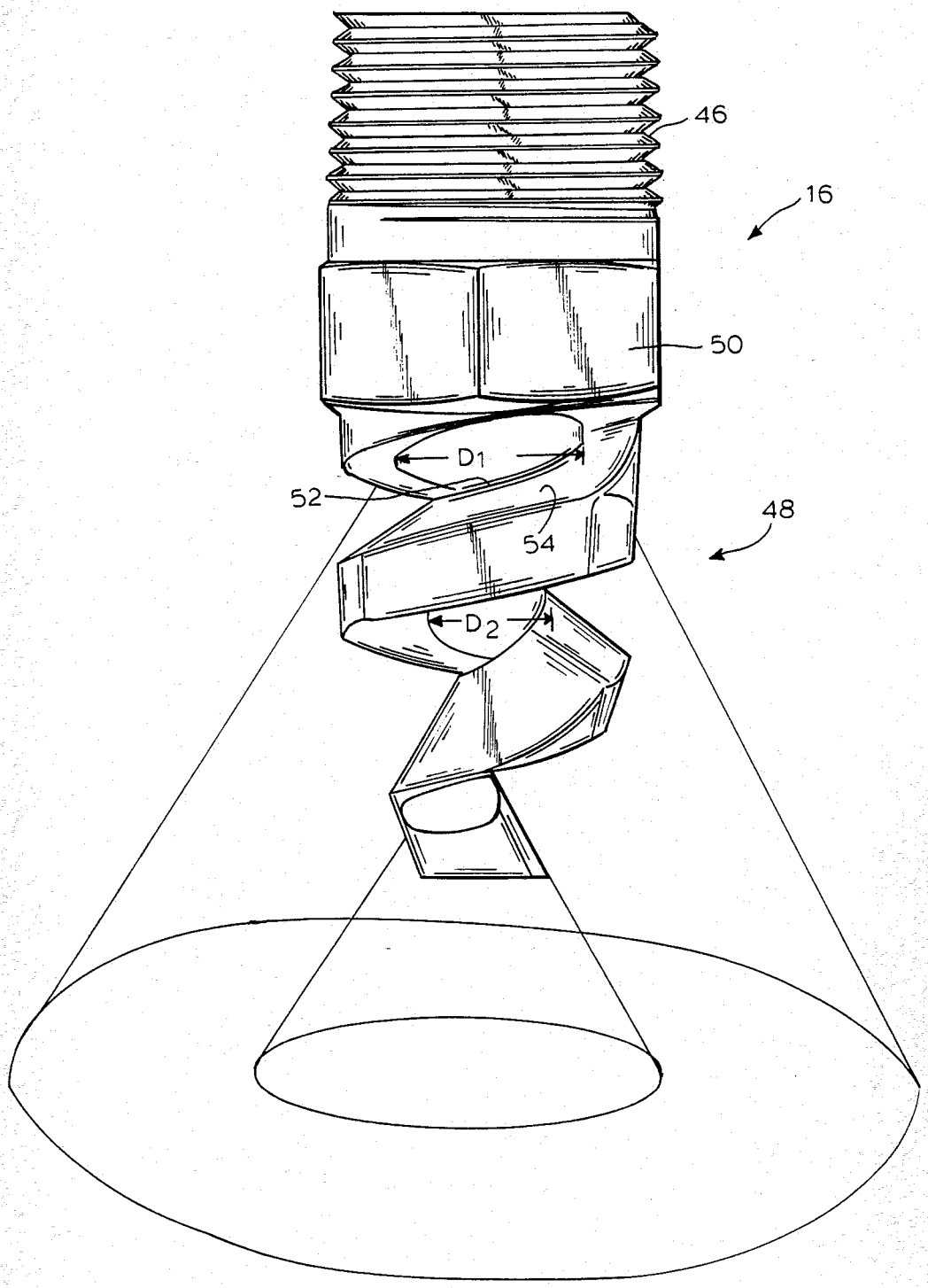
FIG. 2 is an elevational view of one embodiment of a spiral type of spray nozzle which can be utilized in accordance with the teachings of the present invention.

FIG. 2 is an elevational view of one embodiment of a spiral type of open flow spray nozzle 16 utilized pursuant to the teachings of the present invention. The spiral nozzle includes an upper threaded section 46 and a lower spiral, convoluted section 48. The upper section is threadedly coupled to an appropriate infeed conduit, from which the particulate matter slurry is pumped through an upper cylindrical bore 50 to the convoluted lower spiral section 48, in which the diameter of the spiral turns decrease progressively towards the bottom thereof. This is illustrated by the larger upper diameter D1 in the upper portion thereof and the reduced diameter D2 in the lower portion thereof.

During operation of the spiral spray nozzle, the particulate matter slurry is pumped through the upper cylindrical bore 50 into the convoluted lower spiral section 48 in which, as the internal diameter D decreases, the sharp inner and upper edge 52 of the convolute shears the outer diameter portion of the cylindrical slurry stream and directs it along the upper convolute surface 54 radially outwardly and downwardly. This shearing of the central slurry stream is performed progressively through the nozzle as the inner diameter D decreases progressively towards the bottom thereof.

The central slurry stream through the nozzle is open, such that the possibility of clogging therein is substantially reduced, and the central stream defines a downwardly tapered inverted conical shape, the lower point of which terminates near the bottom of the nozzle. The resultant spray pattern is a hollow conical pattern, which in the embodiment described herein defines a 50° hollow conical pattern. Of course, either narrower or broader spray patterns could be utilized in alternative embodiments pursuant to the teachings of the subject invention. Moreover, the open flow spiral nozzle reduces the back pressure across the nozzle, relative to prior art nozzles having a multiplicity of small apertures, which results in higher slurry flow rates through the nozzle and greater aeration of the slurry at the same operating pressure. Alternatively, the open flow spiral nozzle could be operated at a lower pressure while achieving the same slurry flow rates therethrough, relative to the prior art.

Each nozzle may be tilted at an angle with respect to a vertical, (i.e., the position of the nozzle relative to the liquid surface level), such that is functions to direct the flow of froth in a direction towards the skimmer arrangement 28. However, the angle of incidence does not appear to be critical, and the vertical positioning shown in FIG. 1 may be preferred to create a condition most conducive to agitation and froth generation at the water surface. It appears to be significant that the agitation created by the nozzle sprays define a zone of turbulence extending a limited distance beneath the water surface level. Among other means, the depth of the turbulence zone may be adjusted by varying the supply pressure of the slurry in the supply manifolds and also the distance of the nozzles above the water surface. In one operative embodiment, a zone of turbulence extending one to two inches beneath the water surface produce very good agitation and froth generation, although the distance is dependent on many variables such as the tank size, the medium in the tank, etc. and accordingly may vary considerably in other embodiments.

The use of the improved hollow spiral nozzle pursuant to the teachings of the present invention results in a more efficient beneficiation process, as has been proven by the test results plotted in FIGS. 3 through 7 and supported by the data in the following Tables 1 through 13. The following Tables compare beneficiation achieved with a prior art full jet nozzle as disclosed in McGarry, et al. U.S. Pat. No. 4,347,126, available from Spraying Systems Co., Wheaton, Ill., model SS 3050HC, with two types of spiral nozzles, available from Bete Fog Nozzle, Inc., Greenfield, Mass. Two types of spiral nozzle design, a 60° full cone spiral, model TF-12NN, and a 50° hollow cone spiral, model TF-12N, and a full jet hollow cone nozzle model SS 3050HC, were tested and evaluated for coal recovery performance by manipulating nozzle pressures over a wide range.

The results depicted in FIG. 3 demonstrate that the hollow cone spiral design produced the highest recovery at every pressure tested. These nozzles were also tested and evaluated on four coals of different rank and, as can be seen from the grade/recovery curves in FIGS. 4 through 7, the spiral nozzle produced higher coal recoveries than the full jet nozzle in all four cases.

The higher coal recoveries made possible by the spiral nozzle were achieved with lower oil levels in every comparison test run on each of the different ranks of coal.

The cleaning efficiency of the spiral nozzle was shown to be better than the full jet nozzle on both a West Virginia and an Illinois coal in two tests designed to show the effect of ash removal versus length of flotation time. With both coals, the spiral nozzle produced equal or lower ashes at higher recoveries in a shorter flotation time (Table 13).

The reasons for the superiority of this new nozzle lie in the simplicity of its design. The helix form produces finer atomization than the full jet, and the free passage diameter is 42% larger. This provides a higher throughput, causing greater aeration which floats more coal. The spray angle of the spiral nozzle is wider which allows a greater opportunity to envelop more air. This increased aeration allows sharply reduced reagent levels and flotation times. The spiral nozzle has no internal parts to restrict flow or cause clogging, and because of its simplicity, it can be cast instead of machined, thus reducing its manufacturing cost. These nozzles are available from several manufactures in over forty different materials from polypropylene to tungsten carbide.

Two spiral nozzle designs are available, a hollow cone spray pattern which is made in either a 50° or a 120° spray angle, and a full cone spray pattern which is made in a 60°, 90° or 120° spray angle. Both types of spiral designs with the narrowest spray angle were the ones tested against the full jet nozzle. Although several companies manufacture spiral nozzles, the particular spiral nozzles that were tested were made by Bete Fog Nozzle, Inc. of Greenfield, MA.

The beneficiation process of the tests followed the general teachings and disclosure of Burgess et al. U.S. Pat. No. 4,304,573, which is expressly incorporated by reference herein. The tests were run as identically close to each other as possible using the same beneficiation procedure on the same equipment with a Ramoy pump and ball valves, with the exception of the nozzles, with the same types of coal and reagents, such as tall oil, 75% #6 fuel oil/25% #2 fuel oil, copper nitrate sol, $H_2O_2$, and 2-ethylhexanol (frothing agent). In alternative beneficiation processes, other chemical reagents could be utilized, for instance by the use of butoxyethoxypropanol (BEP) or methylisobutylcarbinol (MIBC) as the frothing agent.

In tables 1, 5, 7, 9 and 11, the figures generally indicate the amount (percentage) of material remaining above a screen filter with the indicated mesh size, while the last negative (−) entry indicates the material passed through the 325 mesh screen. In Tables 2 and 3, the nozzle pressure is indicated in parenthesis above the #/T (pounds/ton) of oil figures given in the left column. In Tables 2, 3, 4, 6, 8, 10 and 12, the #/T Oil Level columns refer to pounds/ton of a mixture of 75% #6 fuel oil and 25% #2 fuel oil. In Tables 6, 8, 10 and 12, the columns #/T Frother refer to pounds/ton of the frothing agent 2-ethylhexanol.

The coal used in an initial evaluation was a run-of-mine Illinois #6 seam coal (S-4200), FIG. 3 and Tables 1 through 4. A screen analysis of the ground feed is presented in Table 1. The full jet nozzle (HC-3050) and the hollow cone spiral nozzle (TF-12N) were tested first at pressures of 2, 5, 10, 16 and 22 psig. All other variables were held constant. Three tests were conducted with each nozzle at each pressure. The order in which the tests were run was randomized. Single tests were then run with the full cone spiral nozzle (TF-12NN) on the Illinois coal at the various stated pressure levels.

Other types of coal were also evaluated comparing the hollow cone spiral nozzle and the standard full jet nozzle. These other types of test coal included a refuse of an intermediate ranked coal from Indiana (S-4245), FIG. 4 and Tables 5 and 6, a low ranked run-of-mine coal from Wyoming (S-3950), FIG. 5 and Tables 7 and 8, and two high rank coal flotation feed samples, one from Alabama (AFT-14), FIG. 6 and Tables 9 and 10, and the other from West Virginia (S-4261), FIG. 7 and Tables 11 and 12. Screen analyses of these ground coals are given in Tables 1, 5, 7, 9 and 11. Grade/recovery curves were established on each of these coals by varying the fuel oil levels for each test. All other variables were held constant.

The hollow cone spiral nozzle (TF-12N) demonstrated to be far superior to the full jet nozzle (HC-3050) currently used in beneficiation technology. As is graphically shown in FIG. 3 and the data presented in Tables 2, 3 and 4, the hollow cone spiral nozzle produced higher coal recoveries than either of the other two nozzles, most notably the standard full jet nozzle at every pressure tested. Moreover, on every coal tested, the spiral nozzle produced higher coal recoveries with half the oil levels than did the full jet nozzle. The spiral nozzle also produced better grade/recovery curves with the several types of coals as shown by FIGS. 4, 5, 6 and 7, plotted from the data contained in Tables 6, 8, 10 and 12.

The amount of aeration created by the spiral nozzle produced two to three times as much froth as the full jet nozzle. This higher level of aeration is caused by the greater capacity, the higher discharge velocity and the wider spray angle. The frother levels for both nozzles were found to be comparable. Another benefit of this increased aeration was that the flotation times were reduced by one third.

TABLE 1

| SCREEN ANAYLSIS OF ILLINOIS ROM (S-4200) | | | | |
|---|---|---|---|---|
| U.S. Mesh | Aperture (Microns) | Weight % | Cumulative % Finer | Cumulative % Coarser |
| 100 | 149 | 0.7 | 99.3 | 0.7 |
| 140 | 105 | 5.4 | 93.9 | 6.1 |

TABLE 1-continued

| SCREEN ANAYLSIS OF ILLINOIS ROM (S-4200) | | | | |
|---|---|---|---|---|
| U.S. Mesh | Aperture (Microns) | Weight % | Cumulative % Finer | Cumulative % Coarser |
| 200 | 74 | 14.7 | 79.2 | 20.8 |
| 270 | 53 | 16.3 | 62.9 | 37.1 |
| 325 | 44 | 3.9 | 59.0 | 41.0 |
| −325 | −44 | 59.0 | | |
| | | 100.0 | | |

TABLE 2

| HOLLOW CONE FULL JET NOZZLE TESTS ON ILLINOIS ROM COAL (S-4200) | | | | | | | | | |
|---|---|---|---|---|---|---|---|---|---|
| #/T Oil Level | % Moisture Feed | % Moisture Prod. | % Ash Feed | % Ash Prod. | % Volatiles Feed | % Volatiles Prod. | % Fixed Carbon Feed | % Fixed Carbon Prod. | % Coal Recovery |
| (nozzle pressure) | | | | | | | | | |
| (2 psi) | | | | | | | | | |
| 10 | | 6.9 | 17.55 | 4.09 | 34.11 | 39.41 | 48.35 | 56.51 | 1.72 |
| " | | 8.0 | 16.95 | 3.63 | 29.72 | 39.79 | 48.75 | 56.58 | 1.23 |
| " | | 9.6 | 17.17 | 3.17 | 34.81 | 39.23 | 49.15 | 57.60 | 1.84 |
| (5 psi) | | | | | | | | | |
| 10 | | 13.9 | 17.03 | 4.01 | 34.17 | 39.72 | 48.80 | 56.27 | 6.43 |
| " | | 15.0 | 17.71 | 3.72 | 33.80 | 38.99 | 48.49 | 57.29 | 6.46 |
| " | | 16.0 | 17.53 | 3.33 | 34.09 | 39.72 | 48.38 | 56.95 | 8.09 |
| (10 psi) | | | | | | | | | |
| 10 | | 24.2 | 17.14 | 3.99 | 33.54 | 38.18 | 49.32 | 57.83 | 43.56 |
| " | | 23.4 | 17.43 | 4.11 | 33.31 | 38.40 | 49.26 | 57.49 | 35.40 |
| " | | 26.3 | 17.00 | 4.38 | 33.73 | 38.28 | 49.27 | 57.34 | 36.86 |
| (16 psi) | | | | | | | | | |
| 10 | | 26.2 | 17.39 | 4.34 | 35.09 | 39.58 | 47.52 | 56.08 | 60.30 |
| " | | 26.9 | 17.32 | 4.57 | 33.64 | 38.00 | 49.04 | 57.43 | 68.95 |
| " | | 25.0 | 16.84 | 4.81 | 34.39 | 38.66 | 48.78 | 56.53 | 65.12 |
| (22 psi) | | | | | | | | | |
| 10 | | 26.7 | 17.27 | 5.88 | 34.30 | 38.00 | 48.43 | 56.12 | 88.71 |
| " | | 27.3 | 17.34 | 4.73 | 34.20 | 38.16 | 48.47 | 57.11 | 62.25 |
| " | | 25.9 | 17.28 | 4.55 | 34.41 | 38.86 | 48.31 | 56.59 | 62.33 |

TABLE 3

| HOLLOW CONE SPIRAL NOZZLE TESTS ON ILLINOIS ROM COAL (S-4200) | | | | | | | | | |
|---|---|---|---|---|---|---|---|---|---|
| #/T Oil Level | % Moisture Feed | % Moisture Prod. | Ash Feed | Ash Prod. | % Volatiles Feed | % Volatiles Prod. | % Fixed Carbon Feed | % Fixed Carbon Prod. | % Coal Recovery |
| (nozzle pressure) | | | | | | | | | |
| (2 psi) | | | | | | | | | |
| 10 | | 19.3 | 17.52 | 3.68 | 35.42 | 39.85 | 47.97 | 56.48 | 7.71 |
| " | | 15.4 | 17.44 | 3.79 | 34.32 | 38.94 | 48.34 | 57.27 | 6.90 |
| " | | 16.4 | 17.77 | 3.44 | 33.06 | 39.11 | 49.17 | 57.54 | 10.96 |
| (5 psi) | | | | | | | | | |
| 10 | | 26.9 | 16.61 | 4.59 | 34.12 | 38.29 | 49.27 | 57.12 | 59.64 |
| " | | 22.9 | 17.12 | 4.60 | 34.44 | 39.00 | 48.44 | 56.40 | 57.87 |
| " | | 26.0 | 17.06 | 4.63 | 34.10 | 38.59 | 48.83 | 56.78 | 55.08 |
| (10 psi) | | | | | | | | | |
| 10 | | 26.7 | 17.60 | 6.42 | 33.25 | 36.81 | 49.15 | 56.77 | 88.96 |
| " | | 27.5 | 17.73 | 6.48 | 34.09 | 37.75 | 48.18 | 55.77 | 91.15 |
| " | | 27.8 | 18.25 | 6.82 | 34.12 | 37.58 | 47.63 | 55.60 | 89.68 |
| (16 psi) | | | | | | | | | |
| 10 | | 28.7 | 17.05 | 7.36 | 34.71 | 37.73 | 48.24 | 54.91 | 95.24 |
| " | | 27.5 | 17.53 | 8.00 | 34.87 | 37.82 | 47.56 | 54.18 | 95.83 |
| " | | 27.3 | 17.68 | 7.81 | 34.22 | 37.21 | 48.10 | 54.98 | 95.59 |
| (21 psi) | | | | | | | | | |
| 10 | | 26.4 | 17.99 | 7.85 | 35.71 | 39.01 | 46.31 | 53.15 | 93.38 |
| " | | 26.6 | 17.10 | 7.33 | 34.97 | 37.85 | 47.93 | 54.82 | 95.85 |
| " | | 28.3 | 17.30 | 8.31 | 34.47 | 37.20 | 48.23 | 54.49 | 96.09 |

TABLE 4

| FULL CONE SPIRAL NOZZLE TESTS ON ILLINOIS ROM COAL (S-4200) | | | | | | | | | |
|---|---|---|---|---|---|---|---|---|---|
| #/T Oil Level | Pressure (psi) | % Moisture Prod. | % Ash Feed | % Ash Prod. | % Volatiles Feed | % Volatiles Prod. | % Fixed Carbon Feed | % Fixed Carbon Prod. | % Coal Recovery |
| 10 | 2 | 14.2 | 17.74 | 3.45 | 34.37 | 40.34 | 47.90 | 56.21 | 7.17 |
| 10 | 5 | 20.6 | 17.05 | 4.20 | 34.93 | 40.34 | 48.02 | 55.46 | 35.88 |

TABLE 4-continued

| FULL CONE SPIRAL NOZZLE TESTS ON ILLINOIS ROM COAL (S-4200) | | | | | | | | | |
|---|---|---|---|---|---|---|---|---|---|
| #/T Oil Level | Pressure (psi) | % Moisture Prod. | % Ash Feed | % Ash Prod. | % Volatiles Feed | % Volatiles Prod. | % Fixed Carbon Feed | % Fixed Carbon Prod. | % Coal Recovery |
| 10 | 10 | 26.9 | 16.96 | 4.75 | 34.20 | 38.41 | 48.80 | 56.79 | 78.95 |
| 10 | 16 | 29.0 | 19.79 | 7.55 | 34.10 | 37.90 | 46.11 | 54.55 | 93.55 |
| 10 | 16 | 28.3 | 17.91 | 7.22 | 35.05 | 38.59 | 47.04 | 54.19 | 90.23 |
| 10 | 20 | 26.2 | 14.92 | 6.48 | 34.91 | 37.69 | 50.17 | 55.83 | 92.48 |
| 10 | 20 | 27.7 | 17.73 | 7.33 | 35.11 | 38.51 | 47.16 | 54.17 | 94.11 |

TABLE 5

| SCREEN ANALYSIS OF INDIANA REFUSE (S-4245) | | | | |
|---|---|---|---|---|
| U.S. Mesh | Aperture (Microns) | Weight % | Cumulative % Finer | Cumulative % Coarser |
| 70 | 210 | 0.8 | 99.2 | 0.8 |
| 100 | 149 | 4.1 | 95.1 | 4.9 |
| 140 | 105 | 8.6 | 86.5 | 13.5 |
| 200 | 74 | 8.4 | 78.1 | 21.9 |
| 270 | 53 | 9.3 | 68.8 | 31.2 |
| 325 | 44 | 3.2 | 65.6 | 34.4 |
| −325 | −44 | 65.6 | | |
| | | 100.0 | | |

TABLE 7

| SCREEN ANALYSIS OF WYOMING ROM (S-3950) | | | | |
|---|---|---|---|---|
| U.S. Mesh | Aperture (Microns) | Weight % | Cumulative % Finer | Cumulative % Coarser |
| 140 | 105 | 0.7 | 99.3 | 0.7 |
| 200 | 74 | 2.3 | 97.0 | 3.0 |
| 270 | 53 | 8.3 | 88.7 | 11.3 |
| 325 | 44 | 13.0 | 75.7 | 24.3 |
| −325 | −44 | 75.7 | | |
| | | 100.0 | | |

TABLE 6

| NOZZLE COMPARISON DATA ON INDIANA REFUSE (S-4245) | | | | | | | | | | |
|---|---|---|---|---|---|---|---|---|---|---|
| #/T Oil Level | #/T Frother | % Moisture Feed | % Moisture Prod. | % Ash Feed | % Ash Prod. | % Volatiles Feed | % Volatiles Prod. | % Fixed Carbon Feed | % Fixed Carbon Prod. | % Coal Recovery |
| | | | | 37.4 | | 31.5 | | 31.1 | | |
| FULL JET HOLLOW CONE NOZZLE (HC-3050) | | | | | | | | | | |
| 10 | 0.61 | | 26.5 | 36.18 | 9.70 | 29.17 | 35.64 | 34.66 | 54.67 | 80.6 |
| 10 | 0.61 | | 24.2 | 32.02 | 11.10 | 31.00 | 36.92 | 36.98 | 51.98 | 76.0 |
| 10 | 0.61 | | 26.7 | 33.60 | 10.90 | 30.08 | 35.87 | 36.33 | 53.23 | 75.5 |
| 10 | 0.61 | | 25.6 | 33.82 | 10.82 | 30.74 | 37.04 | 35.44 | 52.14 | 74.6 |
| 5 | 0.61 | | 21.4 | 35.19 | 8.89 | 29.53 | 35.82 | 35.26 | 55.24 | 67.5 |
| 2.5 | 0.61 | | 24.7 | 35.89 | 8.00 | 29.50 | 35.57 | 34.62 | 56.43 | 50.9 |
| SPIRAL HOLLOW CONE NOZZLE (TF-12N) | | | | | | | | | | |
| 10 | 0.61 | | 27.1 | 32.93 | 8.61 | 29.16 | 35.09 | 37.91 | 56.30 | 90.0 |
| 10 | 0.61 | | 25.8 | 33.93 | 9.95 | 29.52 | 35.82 | 36.55 | 54.23 | 89.7 |
| 10 | 0.61 | | 26.5 | 34.61 | 10.75 | 30.42 | 36.91 | 34.97 | 52.34 | 89.2 |
| 10 | 0.61 | | 30.0 | 34.70 | 8.97 | 29.61 | 36.09 | 35.70 | 54.94 | 88.9 |
| 5 | 0.61 | | 26.0 | 35.23 | 10.10 | 28.94 | 34.95 | 35.83 | 54.95 | 83.4 |
| 2.5 | 0.61 | | 24.9 | 34.99 | 10.11 | 29.86 | 35.78 | 35.16 | 54.11 | 73.0 |

TABLE 8

| NOZZLE COMPARISON DATA ON WYOMING ROM (S-3950) | | | | | | | | | | |
|---|---|---|---|---|---|---|---|---|---|---|
| #/T Oil Level | #/T Frother | % Moisture Feed | % Moisture Prod. | % Ash Feed | % Ash Prod. | % Volatiles Feed | % Volatiles Prod. | % Fixed Carbon Feed | % Fixed Carbon Prod. | % Coal Recovery |
| | | | | 25.5 | | 40.3 | | 34.2 | | |
| FULL JET HOLLOW CONE NOZZLE (HC-3050) | | | | | | | | | | |
| 20 | 0.56 | | 24.0 | 26.50 | 14.37 | 36.36 | 39.90 | 37.14 | 45.73 | 86.4 |
| 20 | 0.56 | | 25.8 | 26.12 | 13.56 | 36.83 | 40.64 | 37.04 | 45.80 | 84.2 |
| 20 | 0.56 | | 26.9 | 27.49 | 14.94 | 36.34 | 40.22 | 36.17 | 44.84 | 82.3 |
| 20 | 0.56 | | 26.7 | 26.45 | 12.97 | 36.50 | 40.63 | 37.05 | 46.40 | 80.7 |
| 10 | 0.56 | | 24.7 | 27.11 | 12.83 | 37.13 | 41.71 | 35.76 | 45.46 | 71.0 |
| 5 | 0.56 | | 22.0 | 27.78 | 13.65 | 35.83 | 40.32 | 36.39 | 46.03 | 58.8 |
| SPIRAL HOLLOW CONE NOZZLE (TF-12N) | | | | | | | | | | |
| 20 | 0.56 | | 28.9 | 25.99 | 16.13 | 37.24 | 40.49 | 36.77 | 43.38 | 91.3 |
| 20 | 0.56 | | 29.4 | 26.35 | 16.05 | 36.35 | 39.55 | 37.30 | 44.40 | 90.1 |
| 20 | 0.56 | | 29.3 | 29.10 | 19.33 | 35.03 | 38.07 | 35.88 | 42.61 | 89.3 |
| 20 | 0.56 | | 31.4 | 28.10 | 16.93 | 36.83 | 40.65 | 35.07 | 42.42 | 89.1 |
| 10 | 0.56 | | 28.6 | 27.15 | 14.31 | 36.56 | 40.64 | 36.30 | 45.05 | 84.3 |
| 5 | 0.56 | | 21.6 | 27.47 | 14.24 | 36.35 | 40.67 | 36.19 | 45.09 | 75.0 |

TABLE 9

SCREEN ANALYSIS OF ALABAMA FLOTATION FEED (AFT-14)

| U.S. Mesh | Aperture (Microns) | Weight % | Cumulative % Finer | Cumulative % Coarser |
|---|---|---|---|---|
| 100 | 149 | 0.6 | 99.4 | 0.6 |
| 140 | 105 | 5.6 | 93.8 | 6.2 |
| 200 | 74 | 14.6 | 79.2 | 20.8 |
| 270 | 53 | 17.3 | 61.9 | 38.1 |
| 325 | 44 | 4.9 | 57.0 | 43.0 |
| −325 | −44 | 57.0 | | |
| | | 100.0 | | |

TABLE 10

NOZZLE COMPARISON DATA ON ALABAMA FLOATATION FEED (AFT-14)

| #/T Oil Level | #/T Frother | % Moisture Feed | % Moisture Prod. | % Ash Feed | % Ash Prod. | % Volatiles Feed | % Volatiles Prod. | % Fixed Carbon Feed | % Fixed Carbon Prod. | % Coal Recovery |
|---|---|---|---|---|---|---|---|---|---|---|
| | | | | 25.5 | | 25.44 | | 56.11 | | |
| FULL JET HOLLOW CONE NOZZLE (HC-3050) | | | | | | | | | | |
| 20 | 0.48 | | 23.3 | 18.2 | 8.62 | 25.2 | 26.7 | 56.6 | 64.7 | 92.7 |
| 10 | 0.48 | | 23.7 | 18.8 | 7.58 | 25.6 | 27.4 | 55.7 | 65.0 | 84.9 |
| 5 | 0.48 | | 25.5 | 18.8 | 7.10 | 25.1 | 26.8 | 56.1 | 66.1 | 83.6 |
| 2.5 | 0.48 | | 22.0 | 18.6 | 6.64 | 24.9 | 26.7 | 56.5 | 66.7 | 82.1 |
| 1.25 | 0.48 | | 23.6 | 17.9 | 6.16 | 25.4 | 27.2 | 56.6 | 66.6 | 80.4 |
| SPIRAL HOLLOW CONE NOZZLE (TF-12N) | | | | | | | | | | |
| 20 | 0.51 | | 23.9 | 18.1 | 9.5 | 26.0 | 27.3 | 55.9 | 63.2 | 96.5 |
| 10 | 0.61 | | 23.4 | 18.4 | 9.4 | 25.0 | 26.2 | 56.6 | 64.4 | 96.1 |
| 5 | 0.51 | | 21.3 | 17.7 | 8.6 | 25.0 | 26.3 | 57.3 | 65.1 | 94.6 |
| 2.5 | 0.51 | | 20.4 | 18.5 | 8.3 | 24.7 | 26.1 | 56.8 | 65.7 | 94.2 |

TABLE 11

SCREEN ANALYSIS OF WEST VIRGINIA FLOTAION FEED (S-4261)

| U.S. Mesh | Aperture (Microns) | Weight % | Cumulative % Finer | Cumulative % Coarser |
|---|---|---|---|---|
| 70 | 210 | 0.2 | 99.8 | 0.2 |
| 100 | 149 | 1.6 | 98.2 | 1.8 |
| 140 | 105 | 5.8 | 92.4 | 7.6 |
| 200 | 74 | 9.5 | 82.9 | 17.1 |
| 270 | 53 | 9.7 | 73.2 | 26.8 |
| 325 | 44 | 3.9 | 69.3 | 30.7 |
| −325 | −44 | 69.3 | | |
| | | 100.0 | | |

TABLE 12

NOZZLE COMPARISON DATA ON WEST VIRGINIA FLOTATION FEED (S-4261)

| #/T Oil Level | #/T Frother | % Moisture Feed | % Moisture Prod. | % Ash Feed | % Ash Prod. | % Volatiles Feed | % Volatiles Prod. | % Fixed Carbon Feed | % Fixed Carbon Prod. | % Coal Recovery |
|---|---|---|---|---|---|---|---|---|---|---|
| | | | | 28.0 | | 26.7 | | 45.3 | | |
| FULL JET HOLLOW CONE NOZZLE (HC-3050) | | | | | | | | | | |
| 10 | 0.66 | | 23.2 | 26.8 | 6.4 | 26.2 | 30.9 | 47.0 | 62.6 | 91.7 |
| 10 | 0.66 | | 22.5 | 28.8 | 8.3 | 26.1 | 30.6 | 45.1 | 61.1 | 91.6 |
| 10 | 0.66 | | 21.6 | 27.9 | 7.8 | 26.0 | 30.1 | 46.1 | 62.2 | 91.4 |
| 10 | 0.66 | | 22.0 | 26.8 | 6.2 | 26.7 | 31.5 | 46.5 | 62.3 | 91.2 |
| 5 | 0.66 | | 26.7 | 30.9 | 9.8 | 25.6 | 30.4 | 43.5 | 59.8 | 90.0 |
| 2.5 | 0.66 | | 20.0 | 28.0 | 7.2 | 25.8 | 30.5 | 46.2 | 62.3 | 87.7 |
| SPIRAL HOLLOW CONE NOZZLE (TF-12N) | | | | | | | | | | |
| 10 | 0.66 | | 20.1 | 26.6 | 7.0 | 26.9 | 31.3 | 46.5 | 61.8 | 94.5 |
| 10 | 0.66 | | 23.3 | 26.9 | 7.9 | 26.5 | 30.5 | 46.6 | 61.7 | 94.3 |
| 10 | 0.66 | | 24.2 | 27.0 | 7.7 | 26.1 | 30.2 | 46.8 | 62.1 | 94.2 |
| 10 | 0.66 | | 26.0 | 25.9 | 7.8 | 26.8 | 31.0 | 47.2 | 61.2 | 94.2 |
| 5 | 0.66 | | 22.8 | 27.8 | 8.9 | 26.9 | 31.3 | 45.4 | 59.8 | 93.4 |
| 2.5 | 0.66 | | 19.7 | 28.1 | 8.4 | 26.2 | 30.6 | 45.7 | 61.0 | 92.8 |

TABLE 13

FLOTATION TIME VERSES COAL RECOVERY

| Flotation Time (Mins) | Full Jet Nozzle (3050 HC) % Solids | Full Jet Nozzle % Ash | Full Jet Nozzle % Coal Recovery | Spiral Nozzle (TF-12N) % Solids | Spiral Nozzle % Ash | Spiral Nozzle % Coal Recovery |
|---|---|---|---|---|---|---|
| West Virginia Flotation Feed (Sample 4239) | | | | | | |
| 1 | 16.7 | 6.0 | 62.6 | 18.2 | 6.1 | 82.4 |
| 2 | 13.5 | 6.3 | 78.8 | 10.6 | 6.7 | 95.0 |
| 3 | 7.7 | 6.6 | 86.1 | 3.0 | 7.1 | 97.7 |
| Illinois #6 ROM Coal (Sample No. S4200) | | | | | | |
| 0.5 | 13.9 | 8.3 | 20.3 | 16.1 | 7.9 | 38.2 |
| 1.0 | 12.0 | 8.4 | 30.7 | 15.3 | 8.0 | 58.8 |
| 1.5 | 9.8 | 8.7 | 38.4 | 13.3 | 8.2 | 71.7 |
| 2.0 | 16.5 | 8.7 | 44.3 | 9.0 | 8.6 | 80.0 |
| 2.5 | 9.1 | 8.8 | 48.4 | 7.5 | 8.8 | 84.2 |
| 3.0 | 6.9 | 8.9 | 53.0 | 6.9 | 9.0 | 86.8 |

While a preferred embodiment and several variations of the present invention for a flotation separation arrangement utilizing an improved spiral, open flow nozzle are described in detail herein, it should be apparent that the disclosure and teachings of the present invention will suggest many alternative designs to those skilled in the art.

What is claimed is:

1. Apparatus for froth flotation of a particulate mineral and separation of the mineral from a slurry containing said particulate mineral, said apparatus comprising:

a. a flotation tank including means for skimming froth;

b. at least one spiral, open flow spray nozzle positioned above said flotation tank and means connected to said nozzle for feeding a slurry containing particulate mineral to said spray nozzle, wherein said at least one spiral spray nozzle is a 50° spiral, open flow spray nozzle and said at least one spiral spray nozzle sprays, under a relatively low back pressure, said slurry containing particulate mineral as fine droplets in a hollow cone spray pattern so that the particulate mineral is dispersed through an aeration zone of increasing cross-sectional area into the surface of a liquid in said tank to create a froth phase on the surface thereof in which a quantity of the particulate mineral is floating; and c. means for controlling the agitation created by said at least one spiral spray nozzle to provide a zone of turbulence extending a limited distance beneath the surface of a liquid in said tank.

2. Apparatus for froth flotation separation of the components of a slurry as claimed in claim 1, including means for supplying said at least one spiral spray nozzle with a slurry of coal particles, associated impurities, and surface treating chemicals for the coal particles, whereby the apparatus is utilized for the beneficiation of coal.

3. Apparatus for froth flotation separation of the components of a slurry as claimed in claim 1, including means for supplying said at least one spray nozzle with slurry under pressure in a range of from 2 to 25 psig.

4. Apparatus for froth flotation separation of the components of a slurry as claimed in claim 3, said means supplying said at least one spray nozzle with slurry under pressure in a pressure range of from 10 to 20 psig.

5. A method for froth flotation separation of the components of a slurry having particulate coal therein, said method comprising the steps of:

a. spraying, under pressure in a range of from 2 to 25 psig and under a relatively low back pressure, an input slurry having particulate coal therein through at least one 50° spiral, open flow spray nozzle adapted to cause a hollow cone spray pattern of fine droplets so that the particulate coal is dispersed through an aeration zone of increasing cross-sectional area into a liquid surface to create a froth on the surface in which a quantity of the particulate coal is floating;

b. controlling the agitation created by said at least one spiral spray nozzle to provide a zone of turbulence extending a limited distance beneath the liquid surface; and c. removing the froth from the liquid surface.

6. A method for froth flotation separation of the components of a slurry as claimed in claim 1, wherein said spraying is under a pressure in the range of from 10 to 20 psi.

7. A method for froth flotation separation of the components of a slurry as claimed in claim 5, further comprising the step of supplying the spray nozzle with a slurry of coal particles, associated impurities, and surface treating chemicals for the coal particules, whereby the process is utilized for the beneficiation of coal.

* * * * *

UNITED STATES PATENT AND TRADEMARK OFFICE

CERTIFICATE OF CORRECTION

PATENT NO. : 4,514,291

DATED : April 30, 1985

INVENTOR(S) : Phillip E. McGarry et al.

It is certified that error appears in the above-identified patent and that said Letters Patent are hereby corrected as shown below:

Column 6, Line 3, "4,347,217" should be --4,347,127--;

Column 6, Line 57, "is" should be --it--;

Column 7, Line 56, "manufactures" should be --manufacturers--.

Signed and Sealed this

*Third* Day of *September 1985*

[SEAL]

*Attest:*

DONALD J. QUIGG

*Attesting Officer* *Acting Commissioner of Patents and Trademarks - Designate*